US005237941A

United States Patent [19]

Kraft et al.

[11] Patent Number: 5,237,941

[45] Date of Patent: Aug. 24, 1993

[54] EMBROIDERY HOOP WITH AN OUTER CONTOUR DEVIATING FROM THE CIRCULAR SHAPE

[75] Inventors: Werner Kraft, Kaiserslautern; Paul Reinheimer, Kindsbach, both of Fed. Rep. of Germany

[73] Assignee: Pfaff Industriemaschinen GmbH, Kaiserslautern, Fed. Rep. of Germany

[21] Appl. No.: 634,162

[22] PCT Filed: Apr. 21, 1989

[86] PCT No.: PCT/EP89/00434

§ 371 Date: Jan. 29, 1991

§ 102(e) Date: Jan. 29, 1991

[87] PCT Pub. No.: WO89/12710

PCT Pub. Date: Dec. 28, 1989

[30] Foreign Application Priority Data

Jun. 14, 1988 [DE] Fed. Rep. of Germany ..... 3820215

[51] Int. Cl.[5] ..... D05C 9/04

[52] U.S. Cl. ..... 112/103; 38/102.2

[58] Field of Search ..... 112/103; 38/102.2, 102.91, 38/102

[56] References Cited

U.S. PATENT DOCUMENTS

| | | | |
|---|---|---|---|
| 623,301 | 4/1899 | Allen | 38/102.2 |
| 4,247,998 | 2/1981 | Foss | 112/103 X |
| 4,422,251 | 12/1983 | Hedrick | 38/102.2 |
| 4,451,997 | 6/1984 | Jones | 38/102.2 |
| 4,642,924 | 2/1987 | Sudderth et al. | 38/102.2 |
| 4,762,076 | 8/1988 | Wakaizumi | 38/102.2 |

FOREIGN PATENT DOCUMENTS

| | | | |
|---|---|---|---|
| 761636 | 9/1980 | U.S.S.R. | 38/102.2 |

OTHER PUBLICATIONS

Mechanical Engineering Design, McGraw-Hill Book Co., 4th Edition, pp. 10-13.

*Primary Examiner*—Clifford D. Crowder
*Assistant Examiner*—Paul C. Lewis
*Attorney, Agent, or Firm*—McGlew and Tuttle

[57] ABSTRACT

The object of the present invention is used to clamp the fabric to be embroidered in mechanical and manual embroidery.

In embroidery hoops with an outer contour deviating from the circular shape, the task is to achieve uniform distribution of the contact pressures over the entire clamped surface between the inner hoop and the outer hoop. This task is accomplished by designing the shape of the cross section of the sections of the inner hoop between two axes such that the bending stiffness is essentially constant over the entire circumference of the inner hoop and the extension stiffness decreases continuously between two axes such that it reaches a minimum in the area of the smallest radius of curvature. The cross-sectional shape of the sections of the outer hoop between two axes is designed such that the extension stiffness between two axes changes in the direction opposite the change occurring in the inner frame.

8 Claims, 1 Drawing Sheet

EMBROIDERY HOOP WITH AN OUTER CONTOUR DEVIATING FROM THE CIRCULAR SHAPE

FIELD OF THE INVENTION

This invention pertains in general to embroidery hoops consisting of a closed inner hoop and a tensioned outer hoop surrounding the inner hoop for holding the fabric to be embroidered.

BACKGROUND OF THE INVENTION

The embroidery frames used for locally clamping fabrics on embroidery heads of embroidery machines consist of a closed inner hoop, and a slotted outer hoop which is connected at its ends by a tensioning device and surrounds the fabric of the inner hoop with an intermediate gap. The hoops are made of the same material, such as wood or plastic. To process embroidery patterns of different geometric size, embroidery hoops with round, elliptical and even nearly rectangle-like outer contours with rounded corners are used.

The tensioning device, arranged on the outer hoop outside the symmetry plane, serves to set the holding force between the inner hoop and the outer hoop and permits adaptation to different fabric thicknesses.

Difficulties due to slippage of the fabric as a consequence of the nonuniform distribution of the contact pressures between the inner hoop and the outer hoop, which depends on the local radius of curvature, often occur in the case of the non-circular embroidery hoops that are very commonly used. For example, contact pressure is concentrated in the areas of small radii of curvature, whereas in other areas the contact pressure may drop to such an extent that sufficient clamping of the fabric to be embroidered is not guaranteed.

To avoid these difficulties, circular embroidery hoops with rectangular cross section of the hoop parts in defined diameter steps are known, in order to thus eliminate the effect of different radii of curvature. However, the use of circular tensioning hoops is not advantageous for certain, e.g., elongated embroidery patterns.

SUMMARY AND OBJECTS OF THE INVENTION

It is an object of the present invention to further improve an embroidery hoop with an essentially rectangular outer contour having rounded corner areas and consisting of a closed inner hoop and a tensioned outer loop surrounding the inner hoop holding the fabric to be embroidered between the two hoops. The improvement is such that practically uniform distribution of the contact pressures is achieved over the entire circumference of the embroidery hoop between the inner hoop and the outer hoop.

This task is accomplished by varying the characteristics of the inner hoop between the lesser axis and the greater axis such that the flexural strength or bending stiffness is essentially constant over the entire circumference of the inner hoop and the extension resistance or stiffness in the areas between the two axis decreases continuously such that it reaches a minimum in the area of the smallest radius of curvature.

As a result of deliberate variation of the local rigidity, the distribution of the contact pressures is highly uniform in the entire clamped area of the embroidery hoop due to reduction of the extension stiffness of the inner hoop in the area of the smallest radius of curvature, while a high bending stiffness and the associated low flexibility in the area of the lesser axis are maintained at the same time.

A particularly advantageous embodiment of the inner frame causing the constant bending stiffness is to have the cross section of the inner frame continuously changed from an essentially rectnagular profile in areas of the largest radii of curvature to an essentially T-shaped profile with a horizontally inwardly directed web reaching its minimum cross sectional area, in the areas of the smallest radii of curvature.

The uniformity of the distribution of the contact pressures is further increased by having the rigidity distribution of the outer frame be opposite that of the inner frame and also having the bending stiffness essentially constant over the entire circumference. The extension resistance between the two axis continuously increases such that it reaches a maximum in the area of the smallest radius of curvature. One particularly advantageous embodiment of the outer hoop is to have its cross section in a T-shaped profile, with the horizontally outwardly directed web, changing over to a rectangular profile and maximum cross-sectional area in the area of the smallest radius of curvature.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a section along line III-III in FIG. 2;

FIG. 4 is a section along line IV-IV in FIG. 2; and

FIG. 5 is a section along line V-V in FIG. 2.

DETAILED DESCRIPTION OF THE PREFERRED EMBODIMENT

Figure 1:
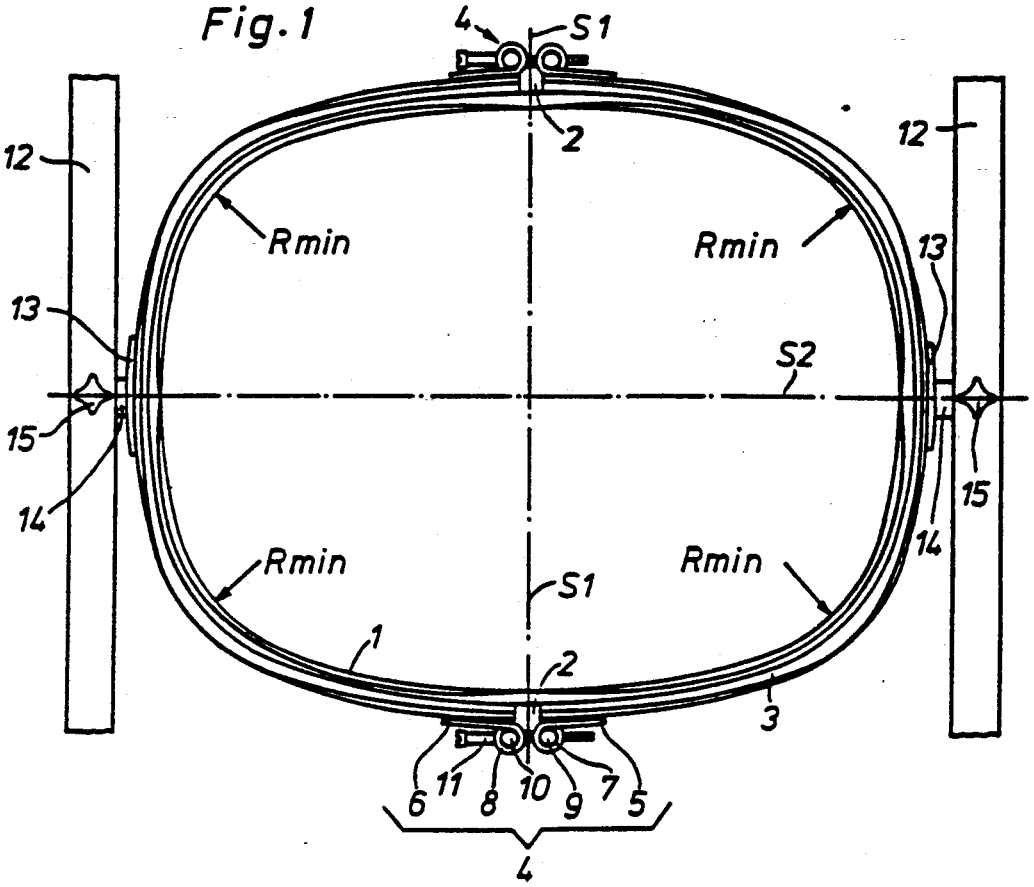
FIG. 1 is a top view of a rectangular embroidery frame with rounded parts and two turnbuckles.
Figure 2:
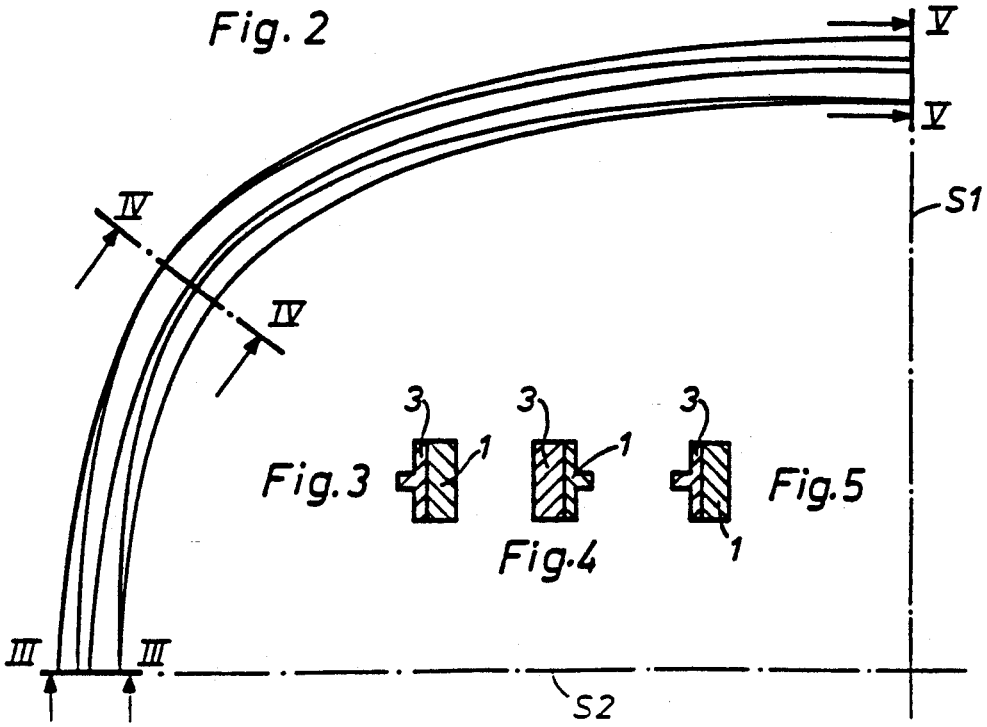
FIG. 2 is a top view of a section of the embroidery frame according to FIG. 1 between two axes on a larger scale.

The embroidery hoop consists of a closed inner hoop 1 of approximately rectangular outer contour with rounded parts and an outer hoop 3, which is slotted at two points at 2 in this embodiment and surrounds the inner hoop 1. The fabric to be embroidered is placed between the inner and outer hoop 1 and 2. The lesser axis of the embroidery hoop is designated by S1 and the greater axis is designated by S2. The areas of the inner hoop and outer hoop 1 and 3 with the smallest radius of curvature are designated by R min. These small radius areas are the areas in which high contact pressure concentrations occur when the cross section of the inner hoop and the outer hoop is uniformly continuous, e.g., rectangular, over the entire developed length.

A turnbuckle 4, consists of two straps 5 and 6, which are fastened on both sides of the point of separation 2 to the outside of the outer hoop 3, e.g., by riveting, and bent into a ring 7, 8 at their end adjacent to the point of separation 2. The turnbuckle is provided at each point of separation 2 of the outer hoop 3. A cylindrical nut 9 is provided with a threaded hole extending transversely and is rotatably inserted in the ring 7 of one strap 5. A cylindrical support 10 is provided with a through hole extending transversely and is rotatably inserted in the ring 8 of the other strap 6. Tightening screw 11, designed as a collar screw, is passed through the hole of the support 10 and is screwed into the threaded hole of the nut 9.

A hoop guide 12 is connected to the control device of the embroidery machine and can be moved in two mutually perpendicular directions, corresponding to the pattern to be embroidered, relative to the embroidery needles. To fasten the embroidery hoop on the hoop guide 12 holding angles 13 are fastened on the outside of the outer hoop 3 on the opposite sides in the area of the greater axis S2. There a horizontal strap 14 of the holding angles has a threaded hole for fastening the embroidery hoop by tommy screws 15, which are passed through a through hole in the hoop guide 12.

Measurements and calculations on non-circular embroidery hoops have revealed that a great reduction of the extension stiffness of the inner hoop 1 in the area of the smallest radii of curvature R min is decisive for achieving uniform distribution of the contact pressures between the inner hoop and the outer hoop. At the same time, the bending stiffness must remain high in order to keep the flexibility in the area of the lesser axis or largest radii of curvature S1 as low as possible. These conditions are satisfied by a special design of the cross section of the inner hoop 1. The shape of the cross section is preferably designed, besides other imaginable cross-sectional shapes, such that in the area of both the lesser axis and the greater axis, the inner hoop has an essentially rectangular cross section, which continuously passes over, beginning from here, into a T-shaped cross section with a horizontally inwardly directed web and reaches a minimum cross sectional area in the area of the smallest radius of curvature.

Uniform distribution of the contact pressures is also achieved by designing the outer hoop 3 correspondingly with a rigidity distribution that is opposite that occurring in the inner hoop 1 and with a modulus of elasticity that is reduced by half compared with that in the inner hoop 1. According to the present invention, the cross sections of the outer hoop 3 between two axes shows, beginning from the greater axis S2, a continuous transition toward the lesser axis S1 from the smallest cross section, a T-shaped profile, rotated through 90° with a horizontally outwardly directed web, according to FIG. 3, to a rectangular cross section according to FIG. 4. The cross section reaches a maximum in the area of the smallest radius of curvature R min and, beginning from there, it further passes over into the T-shaped profile, rotated through 90°, with a horizontally outwardly extending web, according to FIG. 5, whose smallest cross section is reached at the lesser axis S1.

Through this design of the inner hoop and outer hoop, in conjunction with the subdivision of the outer hoop 3 into two and the arrangement of two turnbuckles 4 on the lesser axis S1, by which the longitudinal forces are transmitted within the turnbuckles 4 without additional torque effect, an extremely uniform distribution of the contact pressures between the inner hoop and outer hoop is achieved. The high contact pressure concentrations which occur in the areas of the smallest radii of curvature in the case of a constantly rectangular cross section of the embroidery hoops, and the disadvantages that occur due to insufficient holding forces in the other areas, are completely avoided.

We claim:

1. An embroidery hoop with different radii of curvatures, the embroidery hoop comprising:

an inner hoop;

an outer hoop constructed with a varying cross section causing a substantially constant bending stiffness for a given load along a circumference of said outer hoop independent of the different radii of curvatures, and the extension stiffness of said outer hoop varying form a maximum at the areas of the smallest radii of curvatures to a minimum at the areas of the largest radii of curvatures upon a given load being present, said outer hoop surrounding said inner hoop, and having a tensioning means for tightening said outer hoop around said inner hoop, said outer hoop has a cross sectional area varying from substantially rectangular in the areas of smallest radii of curvature to a substantially T-shaped profile with a minimal cross sectional area in the areas of the largest radii of curvature.

2. An embroidery hoop with a material having a different radii of curvatures, the embroidery hoop comprising:

an inner hoop constructed with a varying cross section causing a substantially constant bending stiffness for a given load along a circumference of said inner hoop, independent of different radii of curvatures, and the extension stiffness of said inner hoop varying from a maximum at the areas of the largest radi of curvature to a minimum at areas of the smallest radii of curvature upon a given load being present, said inner hoop has a cross sectional area varying from substantially rectangular in areas of the largest radii of curvatures to a substantially T-shaped profile with a minimal cross sectional area, in the areas of the smallest radii of curvature; and an outer hoop surrounding said inner hoop, said outer hoop having a tensioning means for tightening said outer hoop around said inner hoop.

3. An embroidery hoop in accordance with one of claims 1 or 2, wherein:

said inner and outer hoops consist of a material each made with a different modulus of elasticity.

4. An embroidery hoop in accordance with claim 3, wherein:

said modulus of elasticity of said outer hoop is substantially half of said modulus of elasticity of said inner hoop.

5. An embroidery hoop in accordance with one of claims 1 or 2, wherein:

said outer hoop is separated at a central axis into two parts connected by tensioning means.

6. An embroidery hoop in accordance with claims 1 or 2, wherein:

said outer hoop defines an opening, said opening having a size larger than said inner hoop, said inner hoop being positioned inside said opening and said tensioning means applying a substantially uniform distribution of contact pressure between said outer hoop and said inner hoop.

7. An embroidery hoop in accordance with claim 2, wherein:

said inner hoop has structural means for changing the extension stiffness for a given load of said inner hoop from said maximum at the areas of the largest radii of curvature to said minimum at said areas of the smallest radii of curvature, said structural means maintaining said substantially constant bending stiffness during said varying of the extension stiffness upon a given load being present.

8. An embroidery hoop in accordance with claims 2, wherein:

said outer hoop has a cross sectional area varying from substantially rectangular in the areas of smallest radii of curvature to a substantially T-shaped profile with a minimal cross sectional area in the areas of the largest radii of curvature.

* * * * *